United States Patent [19]

Kunsagi

[11] 4,398,928

[45] Aug. 16, 1983

[54] ELECTROGASDYNAMICALLY ASSISTED CYCLONE SYSTEM FOR CLEANING FLUE GASES AT HIGH TEMPERATURES AND PRESSURES

[75] Inventor: Laszlo Kunsagi, Upper Montclair, N.J.

[73] Assignee: Foster Wheeler Energy Corporation, Livingston, N.J.

[21] Appl. No.: 416,772

[22] Filed: Sep. 10, 1982

Related U.S. Application Data

[63] Continuation-in-part of Ser. No. 100,789, Dec. 5, 1979, abandoned.

[51] Int. Cl.[3] ..... B03C 3/00

[52] U.S. Cl. ..... 55/107; 55/122; 55/127; 239/504; 239/698; 239/706; 361/228

[58] Field of Search ..... 55/107, 122, 127, 134; 239/3, 706, 696–698, 504, 690; 361/226–228

[56] References Cited

U.S. PATENT DOCUMENTS

| | | | |
|---|---|---|---|
| 1,288,123 | 12/1918 | Mowry | 239/504 |
| 1,363,037 | 12/1920 | Goddard . | |
| 2,207,576 | 7/1940 | Brown | 55/107 |
| 2,711,226 | 6/1955 | Davis . | |
| 2,924,294 | 2/1960 | Johnstone . | |
| 3,521,815 | 7/1970 | Szasz | 239/698 |
| 3,578,997 | 5/1971 | Felici | 239/706 |
| 4,029,482 | 6/1977 | Postma et al. | 55/2 |
| 4,141,698 | 2/1979 | Kihlstedt | 55/107 |
| 4,190,875 | 2/1980 | Smart | 361/228 |

FOREIGN PATENT DOCUMENTS

| | | | |
|---|---|---|---|
| 1184389 | 3/1970 | United Kingdom | 55/2 |

*Primary Examiner*—Bernard Nozick

*Attorney, Agent, or Firm*—Marvin A. Naigur; John E. Wilson; Warren B. Kice

[57] ABSTRACT

A system for separating solid particles from the combustion products of coal in which high temperature, high pressure flue gas containing the particles is directed tangentially into a cyclone separator so that the relatively large particles are driven by centrifugal forces to the inner wall of the separator. Electrical charges generated at ambient temperature are blown into the cyclone separator via aerosol charge-carriers which charge the relatively small particles in a manner so that the small charged particles are attracted to the wall, which is of an opposite polarity, and are scrubbed off the wall by the larger particles. A double-cone flow regulator is positioned in the path of the aerosol charge carriers and the particles to direct the carriers and particles toward the inner wall. An outlet is provided at the lower portion of the cyclone separator for discharging the separated particles and an additional outlet is provided for discharging the clean gas.

11 Claims, 6 Drawing Figures

ELECTROGASDYNAMICALLY ASSISTED CYCLONE SYSTEM FOR CLEANING FLUE GASES AT HIGH TEMPERATURES AND PRESSURES

DESCRIPTION

This application is a continuation-in-part of Ser. No. 100,789, filed Dec. 5, 1979 now abandoned.

BACKGROUND OF THE INVENTION

This invention relates to a system for separating solid particles from a flue gas at high temperatures and pressures and, more particularly, to a separator in which both a centrifugal separation and an electrogasdynamic separation is achieved.

A major constraint on the firing of pulverized coal in electric utility boilers is the collection of large quantities of fly ash. Traditionally, electrostatic precipitators or various types of cyclones have been used to effect the separation of the fly ash from the flue gases.

Cyclone separators are versatile cleanup devices, being applicable to large and small gas flow rates, temperatures up to 2000° F., and pressures exceeding 5 atmospheres. In addition, cyclone separators are relatively insensitive to particle chemistry. However, cyclone separator efficiency decreases markedly for particle sizes below 10 μm.

Electrostatic precipitators can maintain a high efficiency (greater than 95 percent) in a range from less than 1 to 10 μm. However, they are limited to temperatures below 800° F. and pressures in the range of 1 atmosphere, and they are sensitive to particle chemistry. Some of the precipitators have been able to achieve collection efficiencies as high as 99 percent but only at low temperatures (450°–600° F.). Furthermore, since some new regulations require an efficiency in excess of 99.5 percent, and even higher efficiencies are required if the cleaned flue gases are used to drive turbines, these designs have become less than satisfactory, especially since the removal of submicron-size particles required to achieve these efficiencies is impossible by these systems at high temperatures.

Although separators of various types have been suggested to obtain these higher fly ash removal efficiencies at low temperatures, including very elaborate versions of the precipitators mentioned above, they are large and expensive and their reliability is not as high as in previous designs because of their size and large number of components. Furthermore, gas turbine quality flue gas cleaned from the combustion of coal has not been accomplished yet without first cooling, then reheating the gases. Moreover, electric fields can be generated and maintained at high temperatures but only in laboratory conditions and without exposing the electrodes to the impact of high velocity solid particles, since, otherwise, they would erode in a very short time.

SUMMARY OF THE INVENTION

It is therefore an object of the present invention to provide a separating system which achieves high removal efficiencies of solid particles from flue gases at high temperatures and pressures.

It is a more specific object of the present invention to provide a separating system which combines a cyclone centrifugal separator with an electrogasdynamic washing system.

It is a still further object of the present invention to provide a separating system of the above type in which relatively large solid particles are collected on the inner wall of a vessel by centrifugal forces and the small submicron-sized particles are attracted to the wall by an electrogasdynamic charge.

It is a still further object of the present invention to provide a separating system of the above type which achieves the above without the use of moving parts and exposing the components of the electric field generator to the high temperatures, pressures and erosion by generating the charges at ambient temperatures.

It is another object of the present invention to provide a separating system of the above type which is efficient despite short residence time of the charged particles in the system.

Toward the fulfillment of these and other objects, the system of the present invention comprises a cyclone separator in the form of a cylindrical vessel having an inlet at its upper end portion for receiving the flue gas containing the particles, with the inlet being directed tangentially relative to the inner wall of the vessel so that the relatively large particles are driven by centrifugal forces to the lower portion of the inner wall.

Large quantities of high velocity ambient air carrying aerosols are forced through the inlet tube of an electrogasdynamic gun, past an electrogasdynamically charging corona assembly, to keep the gun cool and to charge the droplets in the aerosols. A double-cone diffuser may be positioned in the cyclone separator at the inner end of the inlet tube whereby an upper conical surface deflects the aerosols toward the inner surface of the cyclone separator and into the path of the particles in the dirty flue gas, so that the charged aerosol droplets collide and combine with the dirt particles, transferring their charge to the dirt particles. The considerable kinetic energy of the deflected stream of charged aerosols helps to drive the particles toward the inner wall surface of the separator. A lower conical surface of the double-cone diffuser helps direct upward streaming gas, which contains small uncharged particles, toward the inner wall surface of the separator. A central axial bore in the double-cone diffuser allows charged aerosol droplets to move to the lower parts of the cyclone separator to charge dirt particles there. The charged dirt particles are attracted to the inner wall surface, which is electrically grounded so that these particles are scrubbed off the wall by the larger particles moving downwardly along the inner wall surface as the result of centrifugal forces. The vessel has an outlet located at its lower portion for discharging the separated particles and an outlet for discharging the clean gas.

DESCRIPTION OF THE PREFERRED EMBODIMENTS

Figure 1:
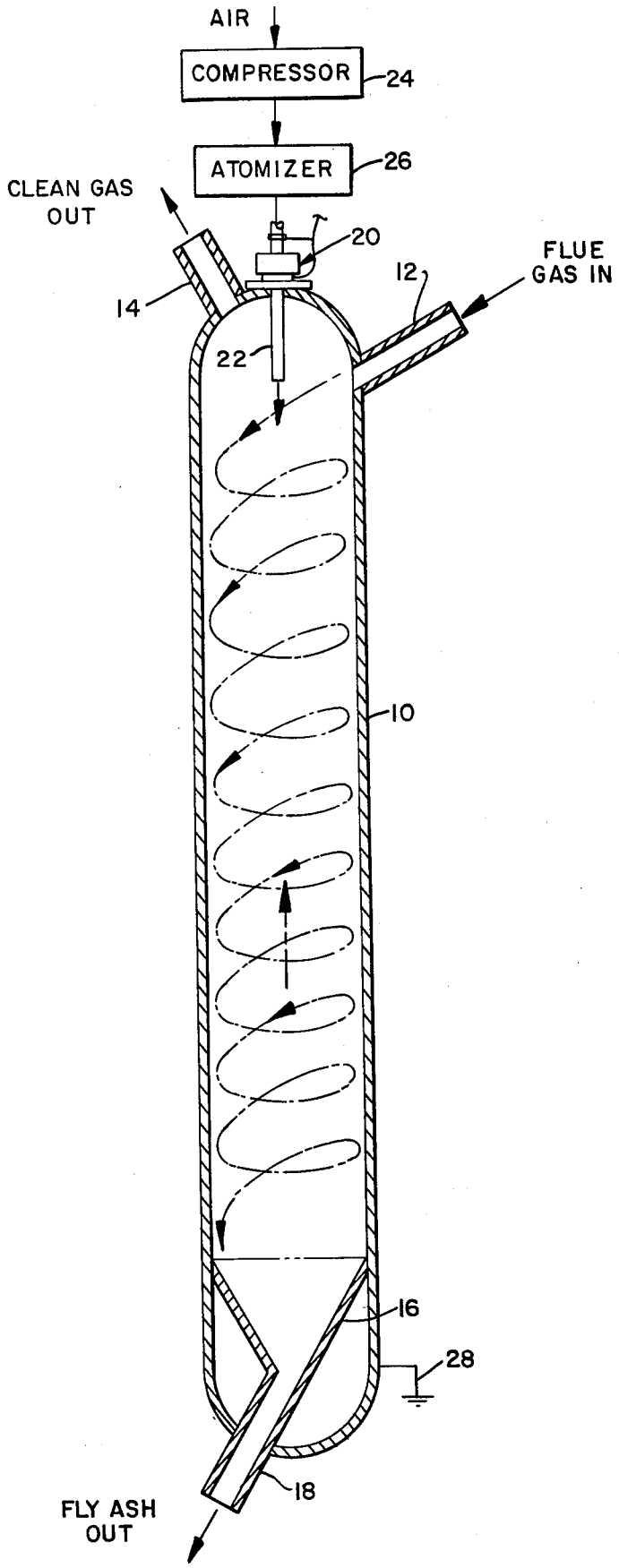
FIG. 1 is a front elevational view of the separating apparatus of the present invention.

As shown in FIG. 1 of the drawings the reference numeral 10 refers to an elongated cylindrical vessel having a hemispherical closure at each end. A flue gas inlet 12 and a clean gas outlet 14 are located at the upper end of the vessel 10. A hopper section 16 is disposed in the lower end of the vessel 10 and registers with an outlet 18 which extends through the lower end of the vessel for discharging the fly ash separated from the flue gas. The inlet 12 is adapted to receive flue gases from a utility boiler, furnace, or the like, and discharge same in a tangential relationship to the inner wall of the vessel where they flow in a spiral path shown by the dashed arrows in the drawing.

An electrogasdynamic gun 20, which will be described in detail later, is disposed on the upper end of the vessel externally thereof and has a discharge tube 22 which extends within the vessel and terminates at a lower end at the same level as the discharge from the flue gas inlet 12. A compressor 24 provided externally of the vessel 10 injects a high velocity, high pressure stream of ambient air into the electrogasdynamic gun 20, sufficient to maintain the electrogasdynamic gun 20 at ambient temperature. An atomizer 26 for introducing water droplets into the air is positioned in the air stream before the latter passes into the electrogasdynamic gun 20. The atomizer 26 can take the form of a bubbler, which is a pressure container filled with water. The air is introduced through a pipe at the bottom of the container and bubbles through the water, picking up small water droplets. The bubbler is self-regulating since the air bubbles cannot absorb water beyond the saturation point. The vessel 10 is electrically grounded, as shown by the reference numeral 23, for reasons that will be described later.

The basic operation of the apparatus thus described involves the introduction of flue gases through the inlet 12 and tangentially against the inner wall surface of the vessel 10 where they flow in a spiral path from the upper portion of the vessel to the lower portion. The centrifugal forces thus created propel the relatively large particles contained in the flue gas against the inner wall where they flow downwardly along the wall by gravitational force toward the hopper 16 and are discharged from the outlet 18. The electrogasdynamic gun 20 operates in a manner to be described in detail later to introduce negatively charged, aerosol charge carriers and air into the interior of the vessel in the vicinity of the area of introduction of the flue gases whereby the relatively fine particles in the flue gases are electrically charged. Since the vessel 10 is electrically grounded, the electrically charged relatively fine particles are attracted to the inner wall surface of the vessel and are scrubbed by the relatively large particles falling down the interior of the wall, and thus also fall into the hopper 16 and discharge from the outlet 18.

Figure 2:
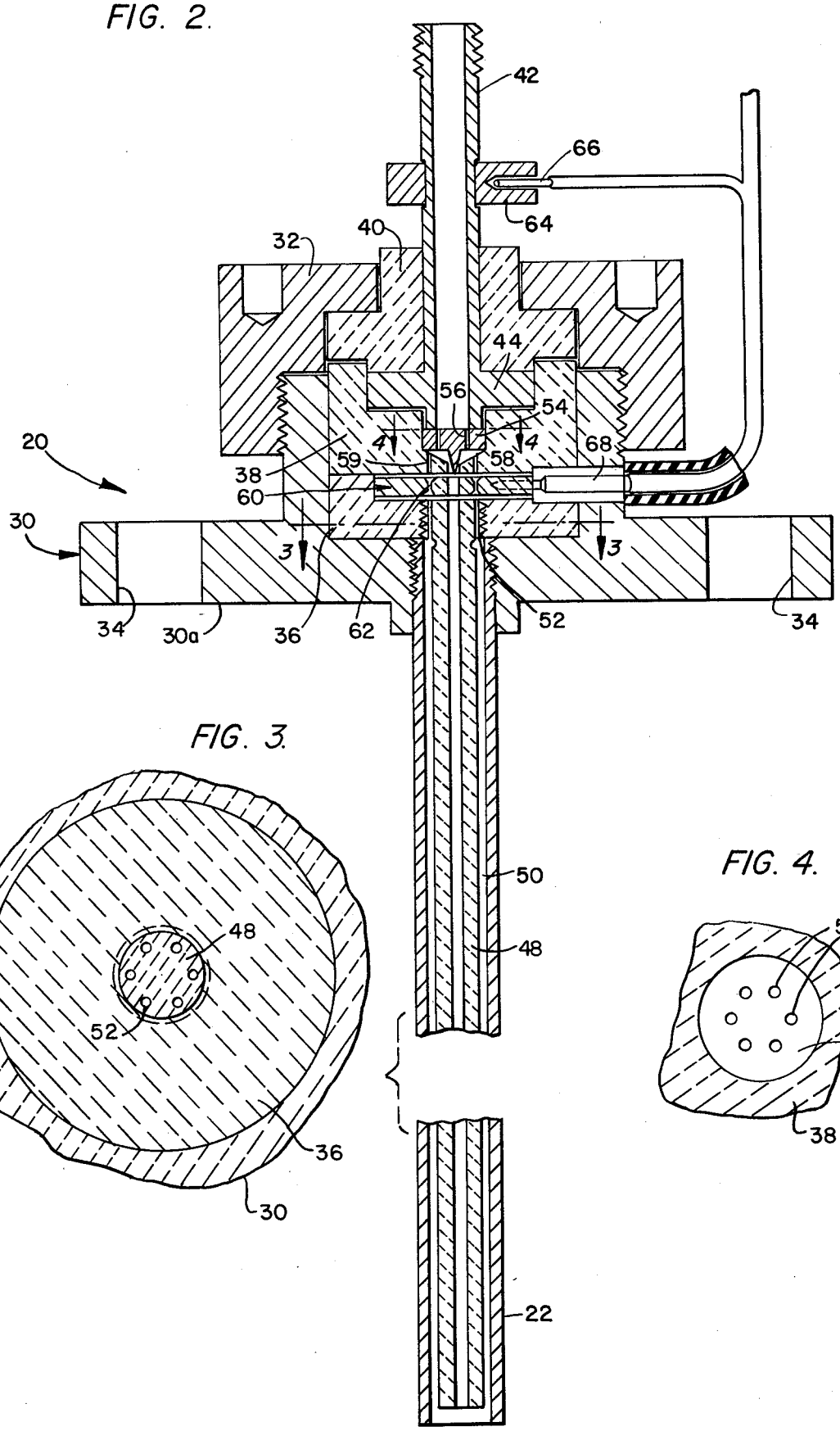
FIG. 2 is a longitudinal sectional view taken along the electrogasdynamic gun used in the apparatus of FIG. 1.

The electrogasdynamic gun 20 is shown in detail in FIG. 2 and comprises a housing formed by a pair of cooperating members 30 and 32. The housing member 30 is formed by a hollow cylindrical portion having a flange 30*a* provided with a plurality of openings 34 which receive bolts or the like for attaching the member, and therefore the gun 20, to the upper end of the vessel 10. The housing member 32 has a hollow portion of varying diameters and is internally threaded to mate with an externally threaded portion formed on the housing member 30. As a result, the location of the housing member 32 relative to the housing member 30 can be adjusted to precisely define the hollow interior portions. Three substantially cylindrical insulating members 36, 38 and 40 are mounted within the interior of the housing members 30 and 32 and define a central bore extending coaxially with the housing members.

Figure 3:
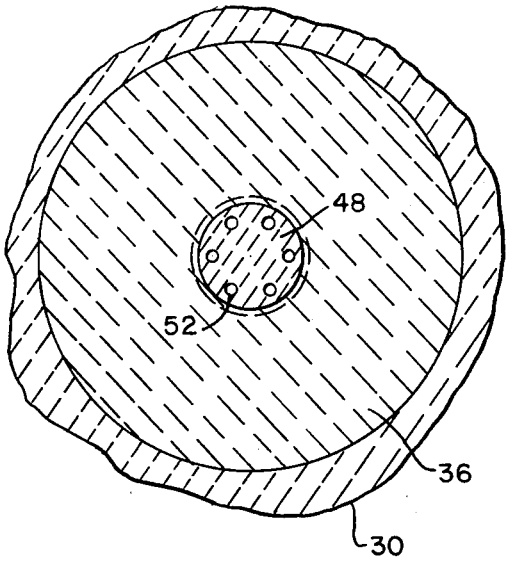
FIG. 3 and FIG. 4 are enlarged cross-sectional views taken along the lines 3—3 and 4—4 respectively, of FIG. 2.

An inlet tube 42 extends into the interior of the housing members 30 and 32, through the bore defined by the insulating members 38 and 40 and has a flange 44 disposed near one end thereof which snugly fits between a corresponding space defined by the insulating members 38 and 40. One end portion of the discharge tube 22 (originally discussed in connection with FIG. 1) threadedly engages with a corresponding threaded internal bore formed in the central portion of the housing member 30, and the other end portion of the tube 22 projects into the interior of the vessel 10. An inner tube 48 extends immediately within the tube 22 in a coaxial relationship thereto, with the outer wall of the tube 48 extending in a spaced relation to the inner wall of the tube 22 to define a annular passage 50. The free end of the inner tube 48 extends just within the free end of the outer tube 46 and the other end of the inner tube is enlarged in diameter and is threadedly engaged within a threaded bore formed in the insulating member 36. As shown in FIG. 3, six passages 52 are formed through the enlarged diameter portion of the inner tube 48 and are disposed in an equiangularly spaced relationship around the central axis of the tube.

Figure 4:
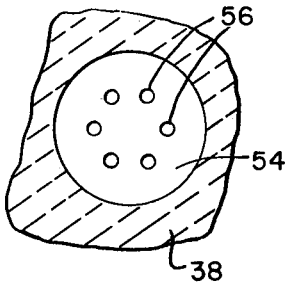

A distributor disc 54 is provided adjacent to the end of the tube 42 and within the interior of the insulating member 38. As shown in FIG. 4 the distributor disc 54 has six passages 56 formed therethrough and disposed in an equiangularly spaced relationship around the central axis thereof. The distributor disc 54 has a conical projecting member, or needle 58, extending from one face thereof. The insulating member 38 defines a space surrounding the needle 58 and a plurality of passages 59 are provided through the insulating member which communicate with the passages 56 of the distribution disc 54.

A second distributor disc 60 is located in a corresponding opening formed in the insulating member 36 in abutment with the corresponding face of the insulating member 38. The disc 60 has a central bore formed therein which communicates with the interior of the inner tube 48, and a plurality of passages 62 spaced about its central axis in an equiangular relationship. The passages 62 communicate with the passages 59, the passages 52 and therefore the annular passage 50.

A mounting flange 64 extends over the projecting portion of the tube 42 and has an opening therein which receives an electrical conductor 66. The distributor disc 60 likewise has a bore formed therein which receives an electrical conductor 68 which shares the same insulation material as the conductor 66. It is understood that the conductors 66 and 68 are connected to a source of electrical power in a manner so that electrons flow from the conductor 66, through the flange 64, the tube 42, the distributor disc 54 and the needle 58, and then flow across the gap between the needle 58 and the distributor disc 60 to the conductor 68. Of course, these conductive components may be fabricated from a conductive material such as stainless steel, or the like.

In the operation of the electrogasdynamic gun 20, ambient air from an external source is compressed by the compressor 24 (FIG. 1) to a pressure exceeding that in the vessel 10, and a fine stream of water droplets from the atomizer 26 is added to the air stream to saturate the air as an aerosol before it is introduced into the free end of the tube 42 of the gun 20. The saturated air stream then passes through the tube 42, through the openings 56 in the distributor disc 54 and over the needle 58 where a supersonic flow velocity is achieved. The saturated air stream continues through the central bore of the tube 48 and through the passages 59, 62 and 52 and the annular passage 50 before the air is discharged from the projecting end of the tube 22 and into the interior of the vessel 10. An electrical current is passed from a power source (not shown) through the conductors 66 and 68 in the manner described above so that electrons flow through the gap between the needle 58 and the disc 60 and into the path of the air flow. As a result, the needle 58 acts as an emitter causing electrons to pass across the saturated air, and the latter becomes charged with the electrons as it discharges into the interior of the vessel 10.

Referring again to FIG. 1, and as mentioned above, the flue gases containing solid particles are introduced through the inlet 12 into the upper end portion of the vessel 10 and flow across the charged, saturated air discharging from the electrogasdynamic gun 20, whereby the relatively fine uncollected solid particles from the flue gases coolide with the aerosol droplets in the saturated air and are charged by the electrons carried thereby.

As also mentioned above, due to the fact the flue gases are introduced in a tangential relation to the inner wall surface of the vessel 10 and thus flow in a spiral path along the inner wall surface of the vessel, the relatively large particles are driven by centrifugal forces toward the inner wall surface and the relative small uncollected charged particles are attracted to this wall since the latter is grounded and thus acts as an attractor. The small particles are then scrubbed by the large particles falling down the interior of the wall, and the resulting mixture of particles falls into the hopper 16 and is discharged through the outlet 18. As a result, an unprecedented high percentage of recovery of both the large and the small particles is achieved.

Figure 5:
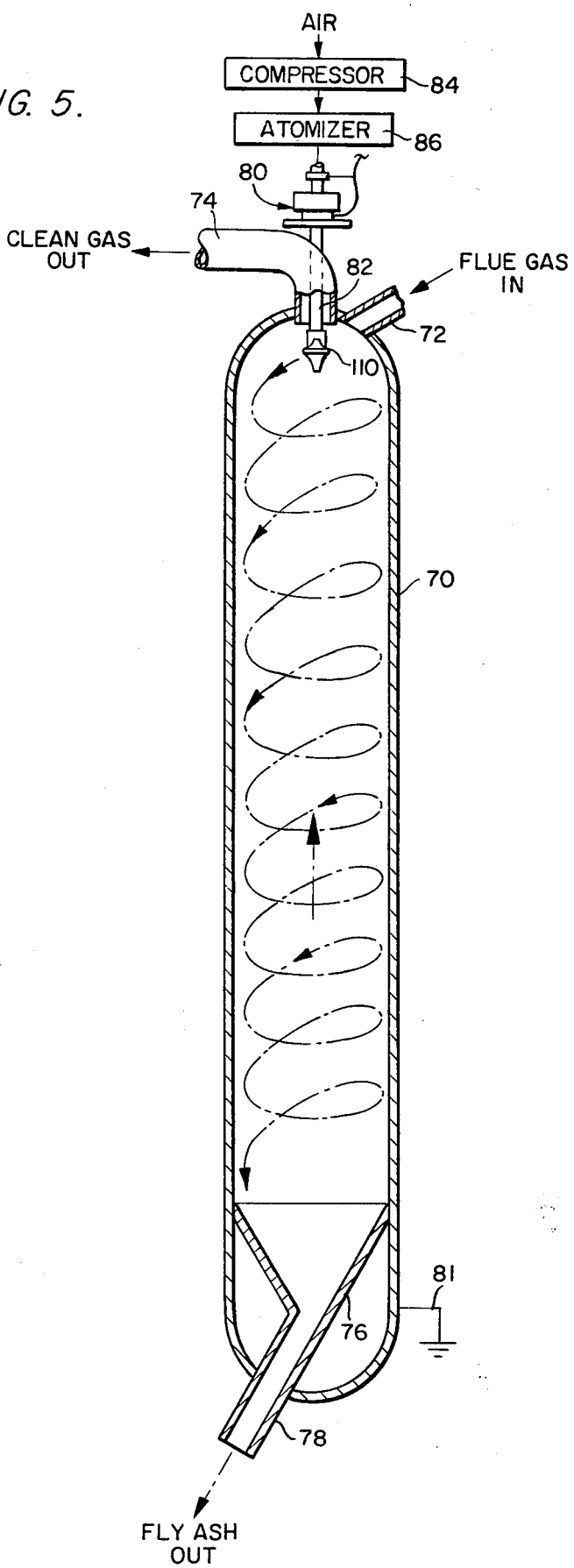
FIG. 5 is a front elevational view of an alternate embodiment of the separating apparatus of the present invention.

As is illustrated in FIG. 5, an alternate embodiment of the electrogasdynamic separator includes an elongated cylindrical vessel 70 having a flue gas inlet 72 and a clean gas outlet 74 located at an upper end portion of the vessel 70. In this embodiment, the clean gas outlet 74 is located centrally at the top of the vessel 70. A hopper section 76 is disposed in the lower end of the vessel 70 and registers with an outlet 78.

An electrogasdynamic gun 80 is supported centrally within the clean gas outlet 74 by any suitable means and has a discharge tube 82 which extends within the vessel 70, extending below the lower end of the clean gas outlet 74 to about the level of the flue gas inlet 72. A compressor 84 and an atomizer 86 similar to those provided for the embodiment of FIGS. 1–4 are provided externally of the vessel 70 for introducing an aerosol of saturated ambient air into the electrogasdynamic gun 80. The vessel 70 is electrically grounded, as is indicated by reference numeral 81.

Figure 6:
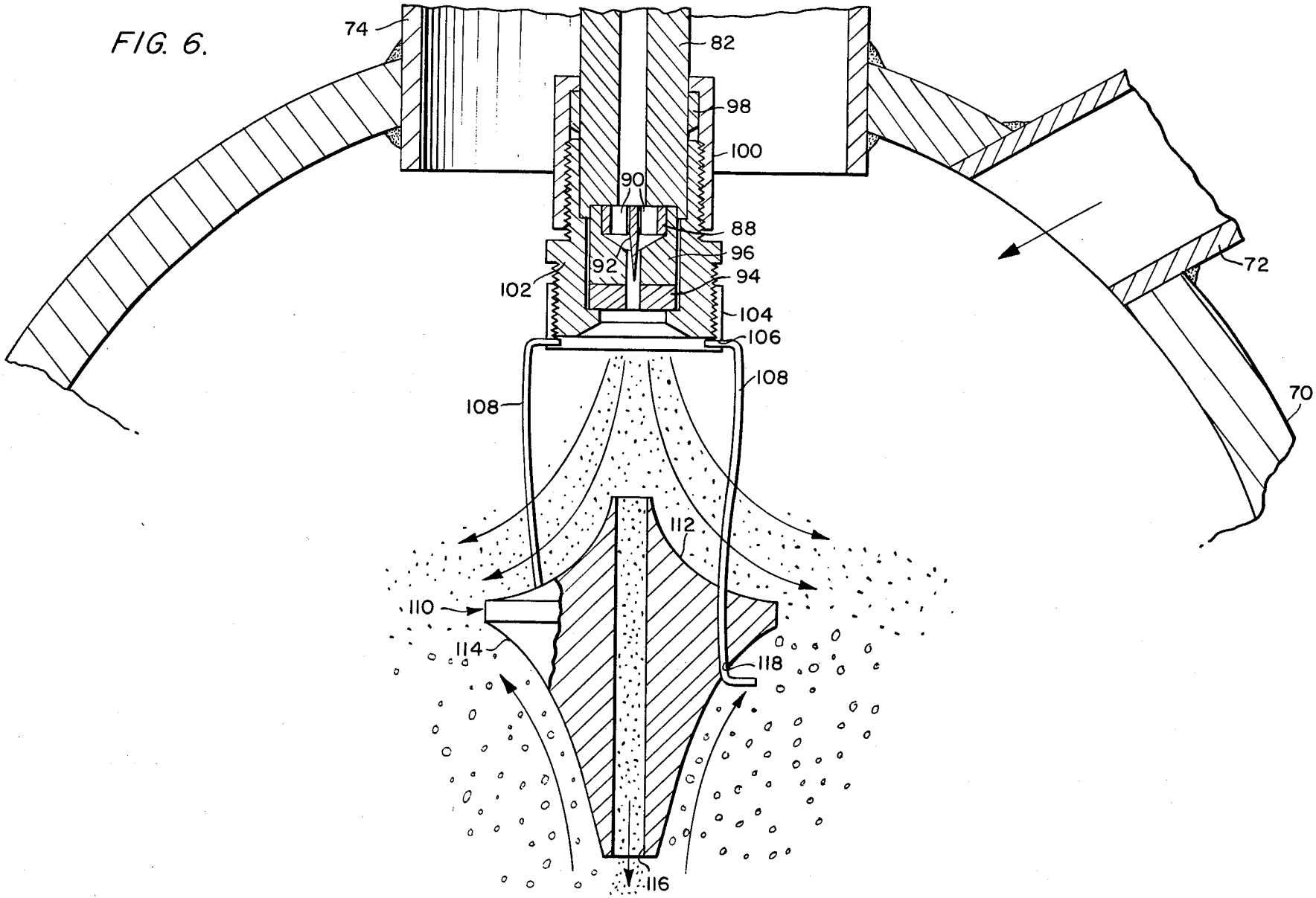
FIG. 6 is an enlarged sectional view of the embodiment of FIG. 5, showing the electrogasdynamic gun and the double-cone diffuser.

As is best illustrated in FIG. 6, the alternate embodiment includes a distributor disc 88 mounted at the inner end of the discharge tube 82, the distributor disc 88 having a plurality of passages 90 defined therethrough and a needle 92 extending from one face thereof. In a manner similar to the embodiment of FIGS. 1–4, the distributor disc 88 is separated from a second distributor disc 94, which is separated from the first distributor disc 88 by an electrically insulating member 96 so that a gap exists between the needle 92 and the second distributor disc 94, and electrical conductors (not shown) are connected to the distributor discs 94 and 96 and to a source of electric power so that electrons flow from the needle 92 across the gap to the second distributor disc 94. The distributor discs 88 and 94 and the insulating member 96 are held in place by an assembly including a collar 98 secured near the lower end of the discharging tube 82, a flanged, internally threaded sleeve 100 rotatably supported by the collar 98, and a cylindrical fitting 102 having an upper externally threaded portion mating with the internally threaded sleeve 100, a lower externally threaded portion and an inwardly extending flange supporting the distributor discs 88 and 94 and the insulating member 96.

An internally threaded ring 104 mates with the lower externally threaded portion of the cylindrical fitting 102 and includes a plurality of spaced apertures 106 for receiving wires 108 or other suitable devices for suspending a double-cone diffuser 110 below the outlet of the discharge tube 82. The double-cone diffuser 110 includes an upper conical surface 112, a lower conical surface 114, and a central axial passage 116. A plurality of bores 118 are provided at spaced locations near the periphery of the double-cone diffuser 110 to receive the lower ends of the wires 108.

In operation, the alternate embodiment of FIGS. 5 and 6 is the same as the embodiment of FIGS. 1–4, except that the stream of charged aerosol droplets issuing from the lower end of the discharge tube 82 is deflected by the upper conical surface 112 of the double-cone diffuser 110 so that it flows to the inner wall surface of the vessel 70 around the entire periphery thereof below the level of the flue gas inlet 72. As a result, the double-cone diffuser 110 forces collisions between the charged aerosol droplets and the dirt particles in the flue gas, which swirl down through the vessel 70 from the flue gas inlet 72, and eliminates any free area between the electrogasdynamic gun and the inner wall surface through which the flue gas might flow without mixing with the aerosol. The collisions result in the charging of the dirt particles so that they are attracted to the inner wall surface. In addition, the high pressure stream of saturated ambient air which comprises the aerosol helps drive the relatively small particles toward the inner wall surface, due to its deflection by the upper conical surface 112. The flow of the tangentially directed incoming flue gas, swirling downward along the inner wall surface of the vessel 70 causes an upward axial flow of gas in the center of the vessel 70. The lower conical surface 114 directs the upward gas flow and the particles it contains toward the inner wall of the vessel 70. A portion of the charged aerosol droplets issuing from the discharge tube 82 pass down through the axial passage 116 in the double-cone diffuser 110 to charge dirt particles in the lower portions of the vessel 70.

It is thus seen that the apparatus of the present invention combines both the advantages of a cyclone centrifugal separator and an electrostatic precipitator in a unique fashion which results in an unprecedented extremely high recovery rate of the solid particles from the flue gases entering the vessel 10 to the extent that the flue gases are cleaned sufficiently to enable them to drive gas turbines. Moreover, these advantages are achieved in a design having no moving parts and with the main components of the electrogasdynamic gun being protected from the relatively high temperatures, erosions and pressures occuring with the aforementioned prior art systems.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

I claim:

1. An apparatus for separating solid particles from a gas at high temperature and pressure comprising a cylindrical vessel having an upper end portion, a lower end portion and an inner wall surface;

an inlet in the upper end portion for receiving the gas containing the solid particles, the inlet being directed tangentially relative to the inner wall surface of the vessel, so that the relatively large particles are driven by centrifugal forces to the inner wall surface;

means for applying an electrical charge to the remaining, relatively small particles, including a charged aerosol inlet positioned centrally at the upper end of the cylindrical vessel and means positioned at the inlet for directing the charged aerosols toward the inner wall surface of the cylindrical vessel around the entire periphery thereof below the level of the inlet for receiving the gas containing the solid particles, the directing means including a diffuser;

means for producing on the inner wall surface an electrical charge having a polarity opposite to the electric charge applied to the relatively small particles, whereby the relatively small particles are attracted to the inner wall surface and scrubbed off by the relatively larger particles moving downwardly along the inner wall surface;

an outlet located at the lower end portion of the vessel for discharging the separated particles; and an outlet extending through the vessel for discharging the cleaned gas.

2. An apparatus for separating solid particles from a gas at high temperature and pressure comprising a cylindrical vessel having an upper end portion, a lower end portion and an inner wall surface;

an inlet in the upper end portion for receiving the gas containing the solid particles, the inlet being directed tangentially relative to the inner wall surface of the vessel, so that the relatively large particles are driven by centrifugal forces to the inner wall surface;

means for applying an electrical charge to the remaining, relatively small particles, said means for applying an electrical charge to said particles comprising means for introducing charged aerosols into said upper end portion of said vessel and into the path of said gas containing said small particles, the introducing means comprising a charged aerosol inlet and a diffuser positioned at the inlet, the diffuser directing the aerosols toward the inner wall surface;

means for producing on the inner wall surface an electrical charge having a polarity opposite to the electric charge applied to the relatively small particles, whereby the relatively small particles are attracted to the inner wall surface and scrubbed off by the relatively larger particles moving downwardly along the inner wall surface;

means for maintaining the charge applying means at ambient temperature;

an outlet located at the lower end portion of the vessel for discharging the separated particles; and an outlet extending through the vessel for discharging the cleaned gas.

3. The apparatus of claim 2 wherein the means for maintaining the charge applying means at ambient temperature comprises means for injecting sufficient amounts of ambient air through the charge applying means to maintain the charge applying means at ambient temperature.

4. The apparatus of claim 2 wherein the diffuser includes an upper conical surface facing and coaxial with the charged aerosol inlet.

5. The apparatus of claim 2 or claim 9 wherein the diffuser includes an axial passage to allow the charged aerosol to flow to lower portions of the vessel.

6. The apparatus of claim 2 or claim 9 wherein the diffuser includes a lower conical surface.

7. The apparatus of claim 6 wherein the diffuser included an axial passage to allow the charged aerosol to flow to lower portions of the vessel.

8. The apparatus of claim 2, wherein said introducing means comprises an electrogasdynamic gun.

9. The apparatus of claim 8 wherein said introducing means further comprises means for passing said aerosols through said electrogasdynamic gun to charge said aerosols.

10. The apparatus of claim 8 wherein said electrogasdynamic gun is located externally of said vessel and operates at ambient temperatures.

11. The apparatus of claim 10 wherein said electrogasdynamic gun includes a discharge tube extending into the interior of said vessel for discharging said aerosols into said vessel.

* * * * *